US010063024B2

(12) United States Patent
Yao et al.

(10) Patent No.: US 10,063,024 B2
(45) Date of Patent: Aug. 28, 2018

(54) ELECTRICAL CONNECTOR HAVING IMPROVED INSULATIVE HOUSING

(71) Applicant: FOXCONN INTERCONNECT TECHNOLOGY LIMITED, Grand Cayman (KY)

(72) Inventors: Tao Yao, Huaian (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/169,963

(22) Filed: Jun. 1, 2016

(65) Prior Publication Data

US 2016/0352041 A1 Dec. 1, 2016

(30) Foreign Application Priority Data

Jun. 1, 2015 (CN) ..... 2015 1 0291211

(51) Int. Cl.

| | |
|---|---|
| ***H01R 9/00*** | (2006.01) |
| ***H01R 43/02*** | (2006.01) |
| ***H01R 13/405*** | (2006.01) |
| ***H01R 12/72*** | (2011.01) |
| ***H01R 13/50*** | (2006.01) |
| *H01R 107/00* | (2006.01) |

(52) U.S. Cl.

CPC ..... *H01R 43/0256* (2013.01); *H01R 12/724* (2013.01); *H01R 13/405* (2013.01); *H01R 13/501* (2013.01); *H01R 2107/00* (2013.01)

(58) Field of Classification Search

CPC ..... H01R 43/0256; H01R 12/724; H01R 13/405; H01R 13/501; H01R 2107/00

USPC ..... 439/607.35, 607.4, 910, 912

See application file for complete search history.

(56) References Cited

U.S. PATENT DOCUMENTS

| | | | | |
|---|---|---|---|---|
| 6,227,893 | B1 * | 5/2001 | Kaneko | G06K 7/0021 439/326 |
| 7,101,230 | B2 * | 9/2006 | Ma | H01R 12/57 439/668 |
| 7,140,918 | B1 * | 11/2006 | Delaney | H01R 23/6873 439/607.06 |
| 7,591,669 | B1 * | 9/2009 | Peng | H01R 12/716 439/489 |
| 9,478,915 | B2 | 10/2016 | Guo et al. | |

(Continued)

FOREIGN PATENT DOCUMENTS

| | | | |
|---|---|---|---|
| CN | 202121098 | U | 1/2012 |
| CN | 202487853 | U | 10/2012 |
| CN | 203056161 | U | 7/2013 |

(Continued)

*Primary Examiner* — Khiem Nguyen

(74) *Attorney, Agent, or Firm* — Wei Te Chung; Ming Chieh Chang

(57) ABSTRACT

An electrical connector includes an insulative housing, a number of terminals carried by the insulative housing, a metallic shielding plate retained in the insulative housing, and a shielding shell attached to the insulative housing. The insulative housing has a number of receiving slots located at a back-end thereof. The terminals have a number of soldering portions exposed from the insulative housing. Each receiving slot is located between every two neighboring soldering portions to receive soldering material.

13 Claims, 9 Drawing Sheets

(56) References Cited

U.S. PATENT DOCUMENTS 9,484,679 B2 11/2016 Guo et al.

FOREIGN PATENT DOCUMENTS

| | | | |
|---|---|---|---|
| CN | 203631831 | U | 6/2014 |
| CN | 103986000 | A | 8/2014 |
| CN | 104377491 | A | 2/2015 |
| CN | 105449438 | | 4/2015 |
| CN | 204243262 | | 4/2015 |
| CN | 204243365 | | 4/2015 |
| CN | 204315813 | U | 5/2015 |
| CN | 204632967 | | 5/2015 |
| CN | 104852204 | A | 8/2015 |
| CN | 105048144 | A | 11/2015 |
| CN | 105048148 | A | 11/2015 |
| CN | 204809444 | U | 11/2015 |
| TW | M358454 | U1 | 6/2009 |
| TW | 426926 | | 4/2012 |
| TW | 201301668 | | 1/2013 |

* cited by examiner

ELECTRICAL CONNECTOR HAVING IMPROVED INSULATIVE HOUSING

BACKGROUND OF THE INVENTION

1. Field of the Invention

The present invention relates to an electrical connector including an improved insulative housing with receiving slots for soldering materials.

2. Description of Related Art

Universal Serial Bus (USB) and USB connectors are well known in the art. China Patent No. 204632967 discloses a reversible electrical connector. The electrical connector includes a shielding shell, an insulative housing, a first and second arrays of contacts insert-molded in the housing, a rear plate extending from a rear end of the shielding shell, and a connection connecting the rear plate and the shielding shell. Each of the first array of contacts has a first soldering section extending from the housing and each of the second array of contacts has a second soldering section extending from the housing. The rear plate has a resisting section and an opening located at the resisting section to observe the second soldering sections. The soldering sections of the contacts insert-molded with the housing decrease volatilization of rosin flux mixed in the soldering material in soldering process. As a result, the rosin flux distilled or separated out from the soldering material may accumulate to such an extent as to cause null or empty soldering.

Hence, a new and simple electrical connector is desired.

SUMMARY OF THE INVENTION

Accordingly, the object of the present invention is to provide an electrical connector comprising: an insulative housing having a plurality of receiving slots located at a back-end thereof; a plurality of terminals carried by the insulative housing, the terminals having a plurality of soldering portions exposed from the insulative housing, each receiving slot being located between every two neighboring soldering portions to receive soldering material; a metallic shielding plate retained in the insulative housing; and a shielding shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
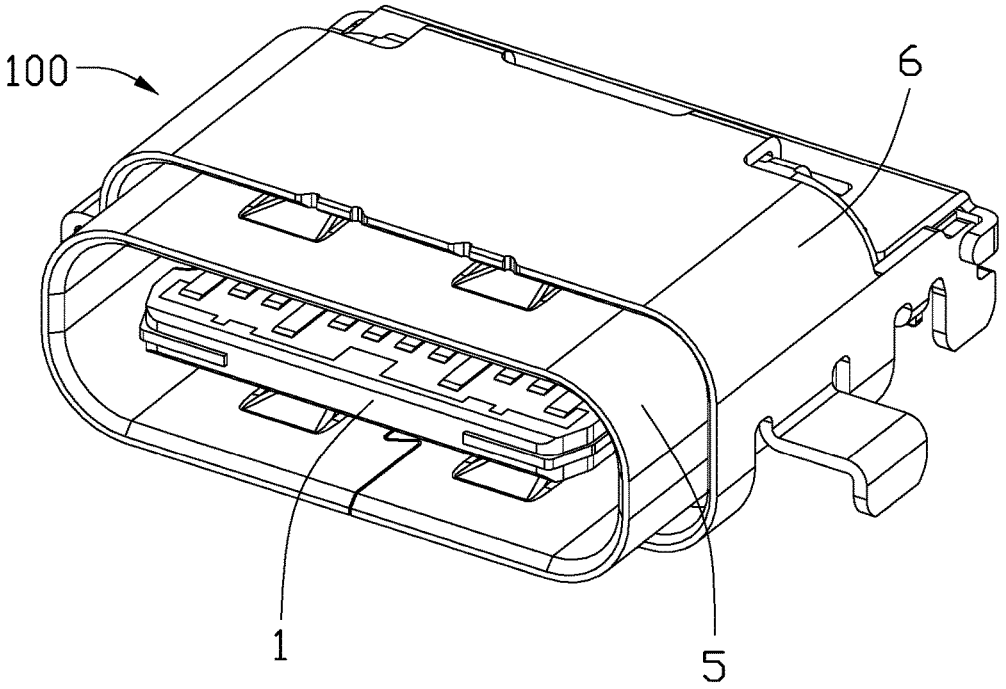
FIG. 1 is a perspective, assembled view of an electrical connector.

Reference will now be made in detail to the preferred embodiment of the present invention.

FIGS. 1-9 show an electrical connector 100 mounted upon a printed circuit board 200 and cooperated with a plug connector. For convenience, the electronic connector 100 defines an insertion direction, a transverse direction perpendicular to the insertion direction and forming a horizontal plane therebetween, and an up-and-down direction perpendicular to the insertion direction and the transverse direction in FIG. 1.

The electrical connector 100 includes an insulative housing 1, a number of terminals 2 and a metallic shielding plate 3 retained in the insulative housing 1, a glue wall 4 sealing a back of the insulative housing 1, a shielding shell 5 formed with a mating cavity to receive the insulative housing 1, and a metal shell 6 attached to the shielding shell 5 to commonly form a metallic shell subassembly.

Referring to FIGS. 3-8, the insulative housing 1 includes a first insulative housing 11, a second insulative housing 12, and a third insulative housing 13. The first insulative housing 11 includes a first base portion 111 and a first tongue portion 112 extending forwardly from the first base portion 111. The first base portion 111 has a pair of depression 113 located at two sides thereof, a number of through-holes 114 communicated with an upper surface and the lower surface thereof, and a pair of receiving holes 115 located at two sides of the through-holes 114. The first tongue portion 112 has an aperture 116 located at a front end thereof. The first base portion 111 has a number of first receiving slots 117 form in an undersurface of the first base portion 111 and located at a rear end thereof to store scaling powders in soldering process.

The second insulative housing 12 includes a second base portion 121 and a second tongue portion 122 extending forwardly from the second base portion 121. The second base portion 121 has a pair of projections 123 extending upwardly and locking the depressions 113 of the first insulative housing 11 and a pair of bumps 124 located at a rear end and protruding to the receiving hole 115. The second base portion 121 has a bulge 125 located at a front end and protruding to the aperture 116. The second base portion 121 has a pair of concaved portions 126 located at two sides of a bottom surface thereof and a number of second receiving slots 127 formed in an undersurface of the second base portion 121 and located at a rear end thereof to store soldering material in soldering process. The first base portion 111 and the second base portion 121 are respectively formed with openings 110, 120. In sealing process, the openings 110, 120 are filled by sealing materials to enhance waterproof function. The third insulative housing 13 includes a third base portion 131 and a third tongue portion 132 extending forwardly from the third base portion 131. The third tongue portion 132 defines a hollow section 133 receiving the first tongue portion 112 and the second tongue portion 122 and a sunken portion 134 located at two sides thereof.

Figure 2:
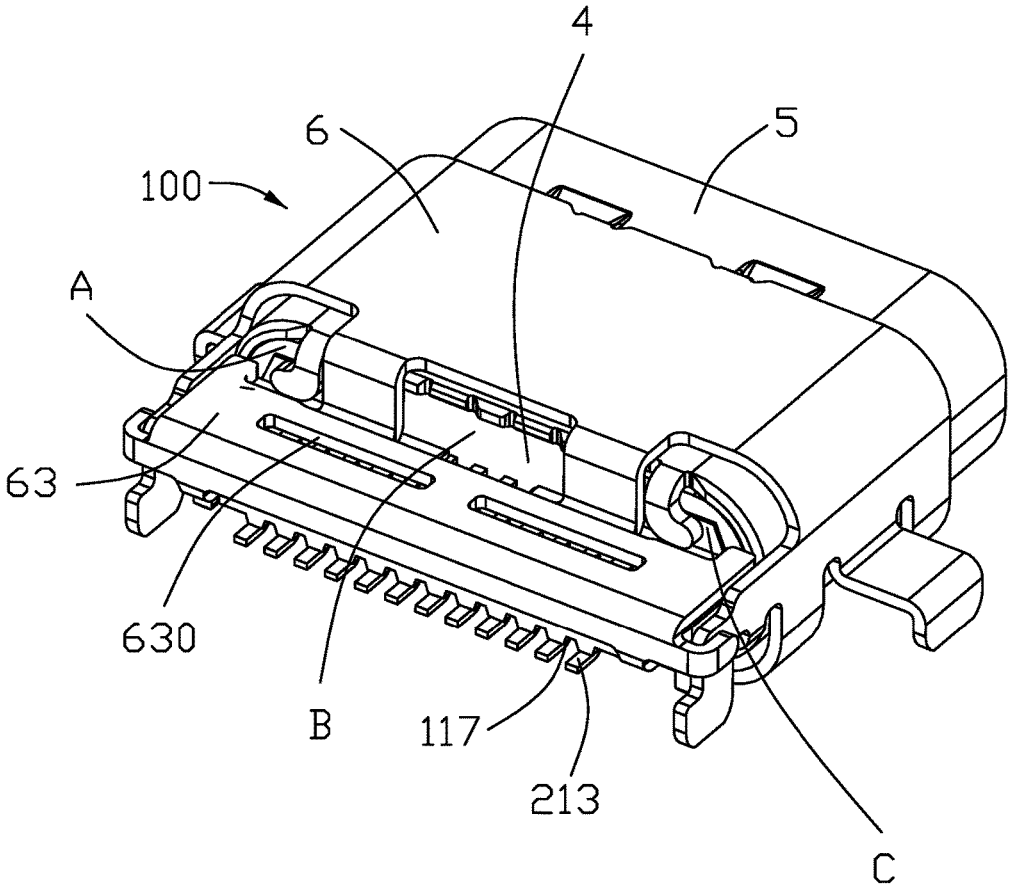
FIG. 2 is another perspective, assembled view of FIG. 1.
Figure 3:
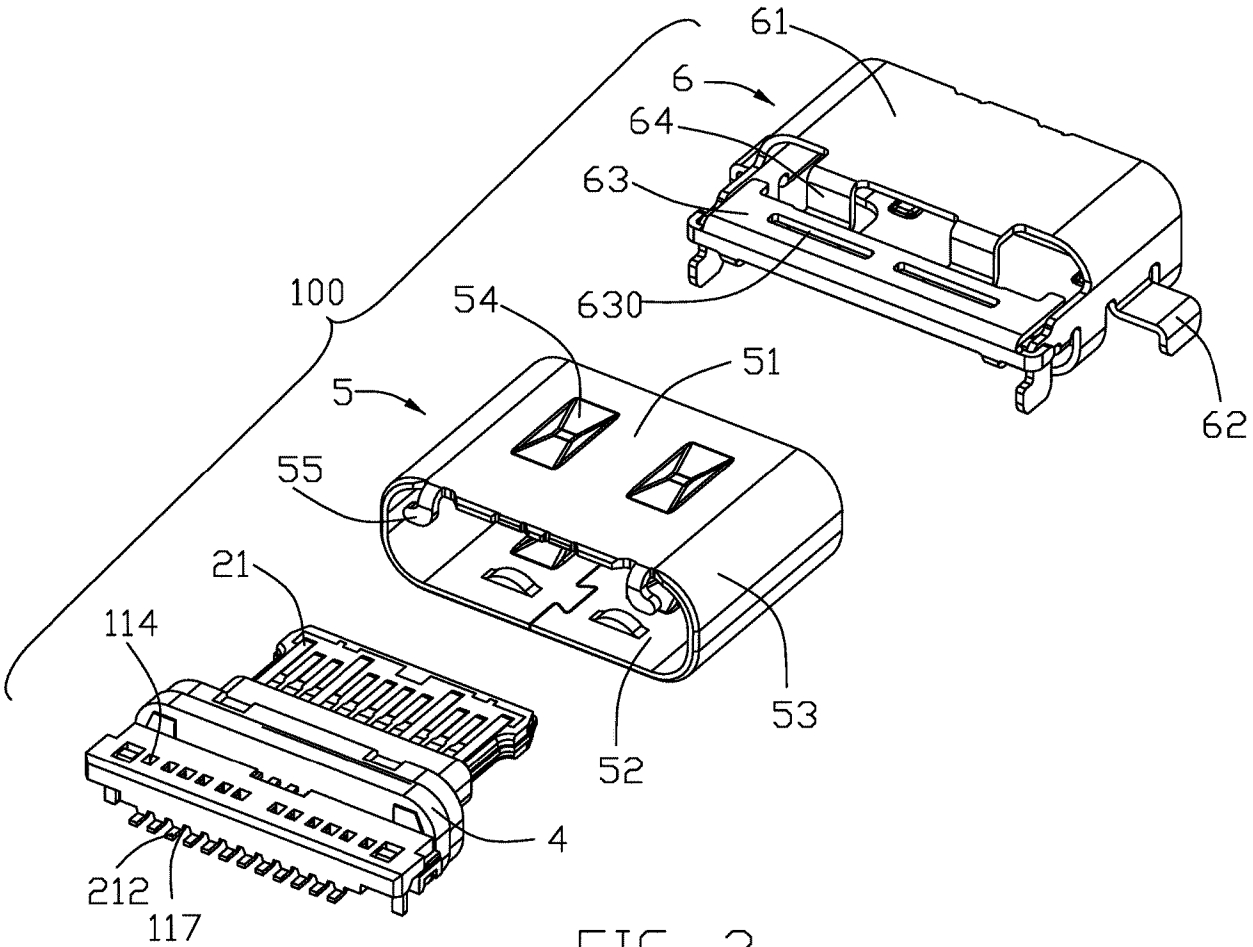
FIG. 3 is a perspective view of the electrical connector separated from a shielding shell and a metal shell.
Figure 4:
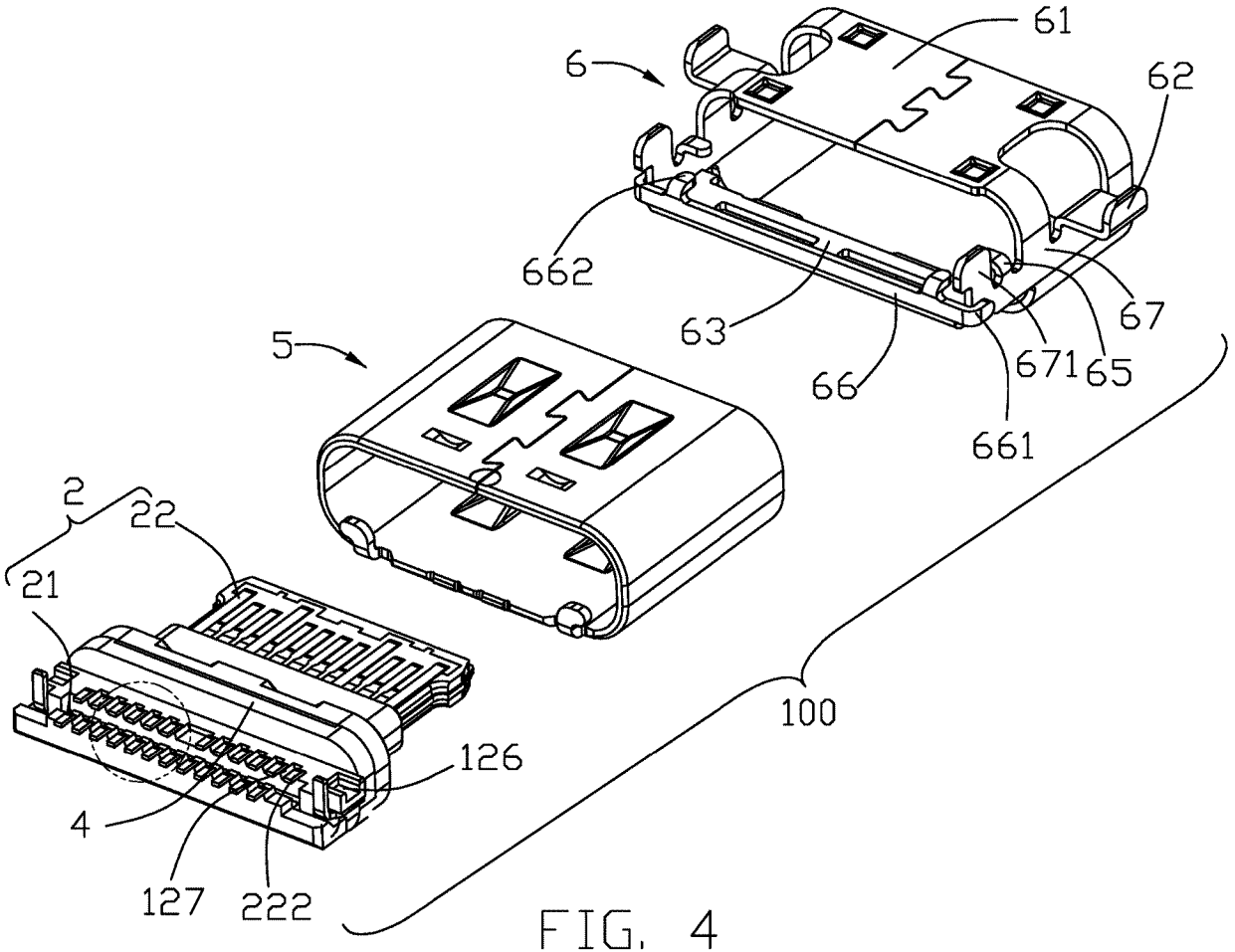
FIG. 4 is another perspective view similar to FIG. 3.
Figure 5:
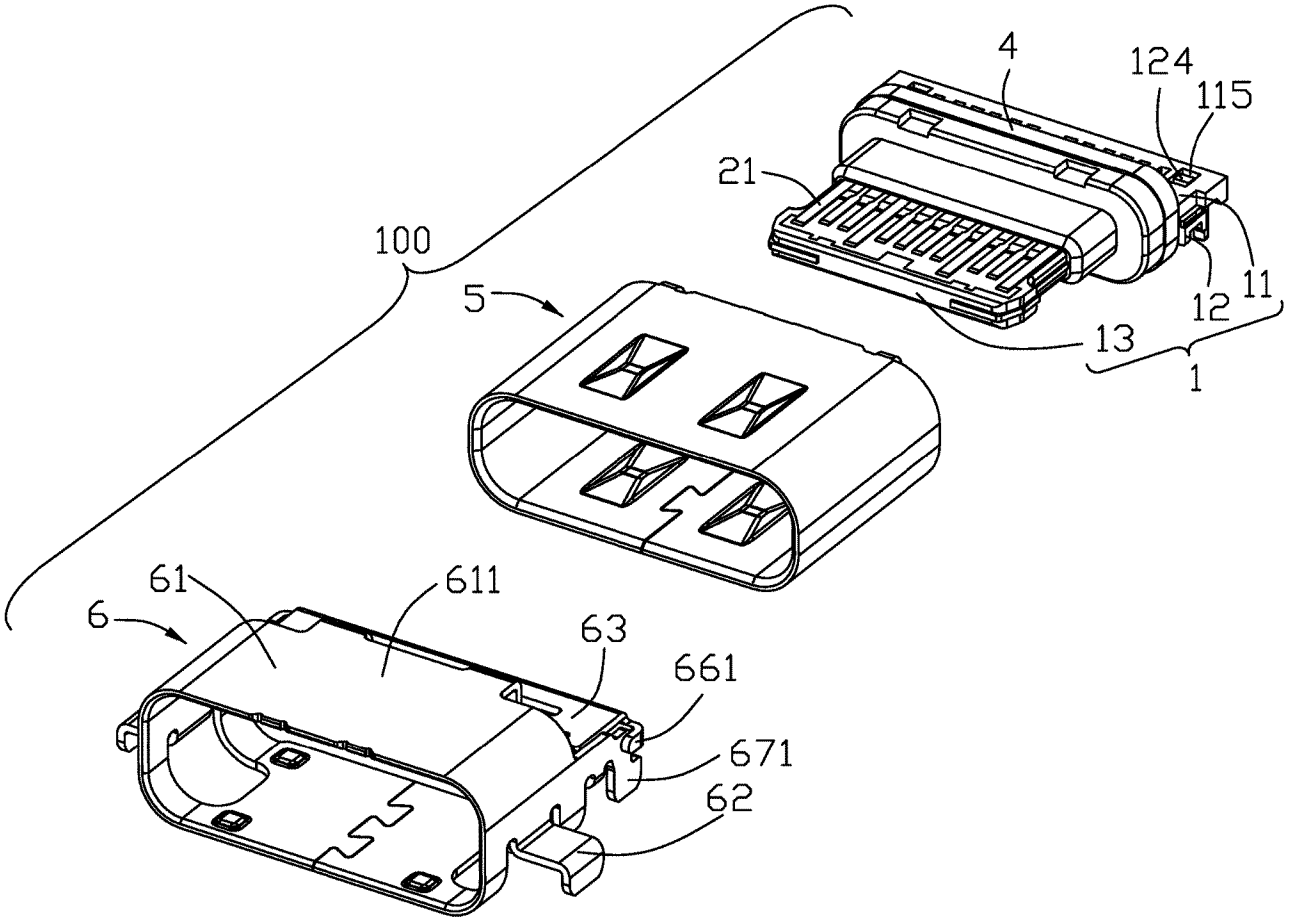
FIG. 5 is another perspective view similar to FIG. 4.
Figure 9:
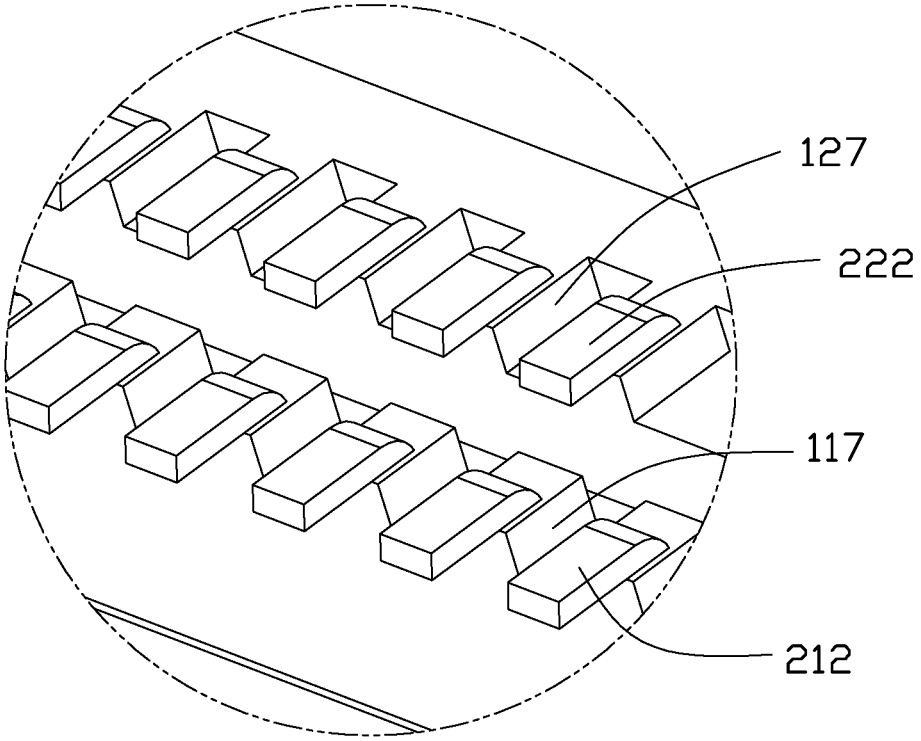
FIG. 9 is a partly enlarged view of FIG. 4.

The terminals 2 include a number of first contacts 21 located in an upper row and carried by the first tongue portion 112 and a number of second contacts 22 located in a lower row and carried by the second tongue portion 122. Each of the first contacts 21 includes a first contacting portion 211 disposed in an upper surface of the first tongue portion 112, and a first soldering portion 212 extending from a back end of the first base portion 111. Each of the second contacts 22 includes a second contacting portion 221 disposed in a bottom surface of the second tongue portion 122, and a second soldering portion 222 extending from a back end of the second base portion 121. Referring to FIG. 2, FIG. 3, and FIG. 9, the first soldering portions 212 are separated by the first receiving slots 117 one by one, and the second soldering portions 222 are separated by the second receiving slots 127 one by one. In other words, every two neighboring first soldering portions 212 have a first receiving slot 117 located therebetween, and every two neighboring second soldering portions 222 have a second receiving slot 127 located therebetween. The first soldering portions 212 and the second soldering portions 222 are located at a same plane and configured in two rows. The two rows of the first soldering portions 212 and the second soldering portions 222 are offset in the transverse direction to observe conveniently the configuration.

Figure 6:
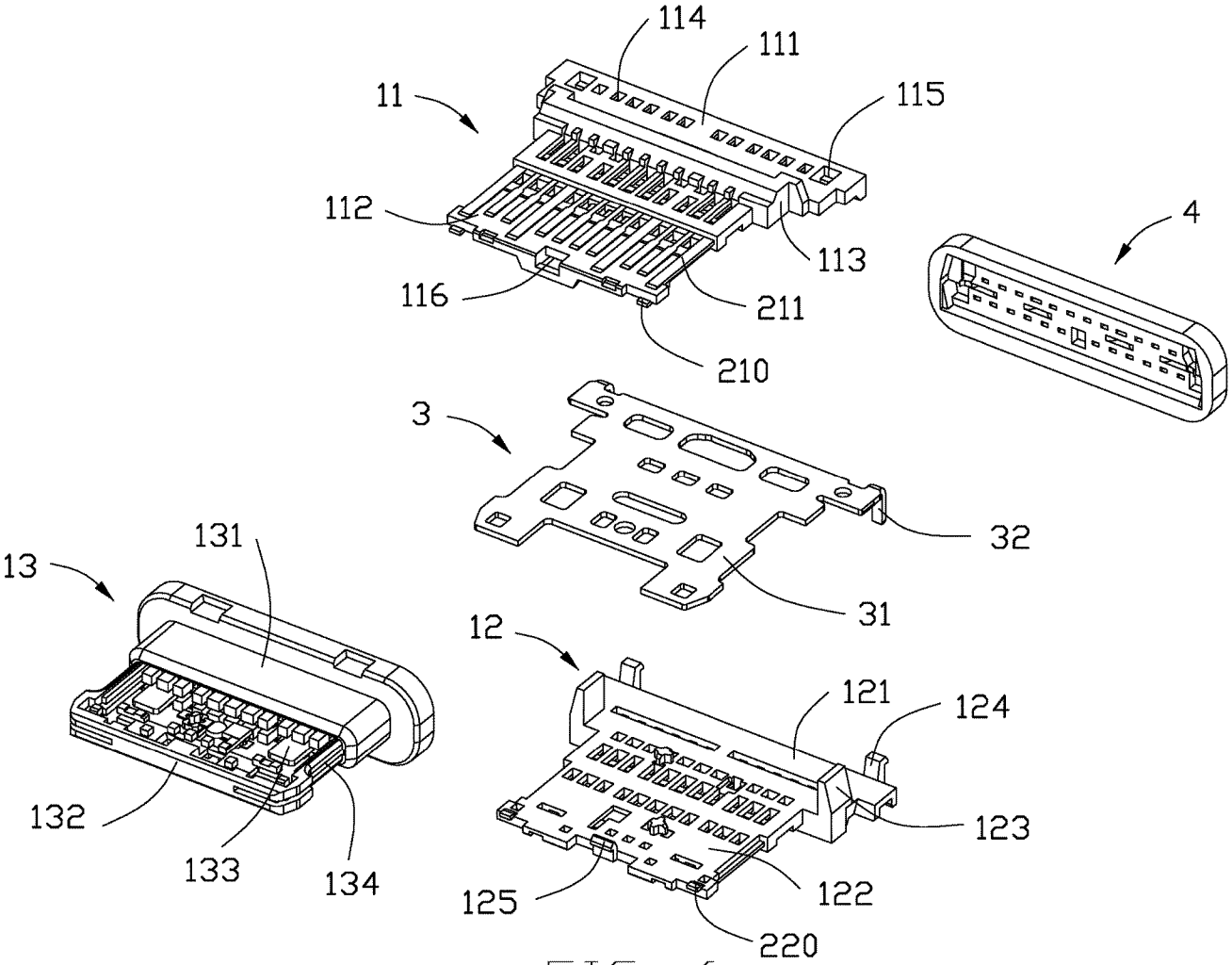
FIG. 6 is perspective view of an insulative housing, a number of terminals, a shielding plate, and a glue wall of the electrical connector.
Figure 7:
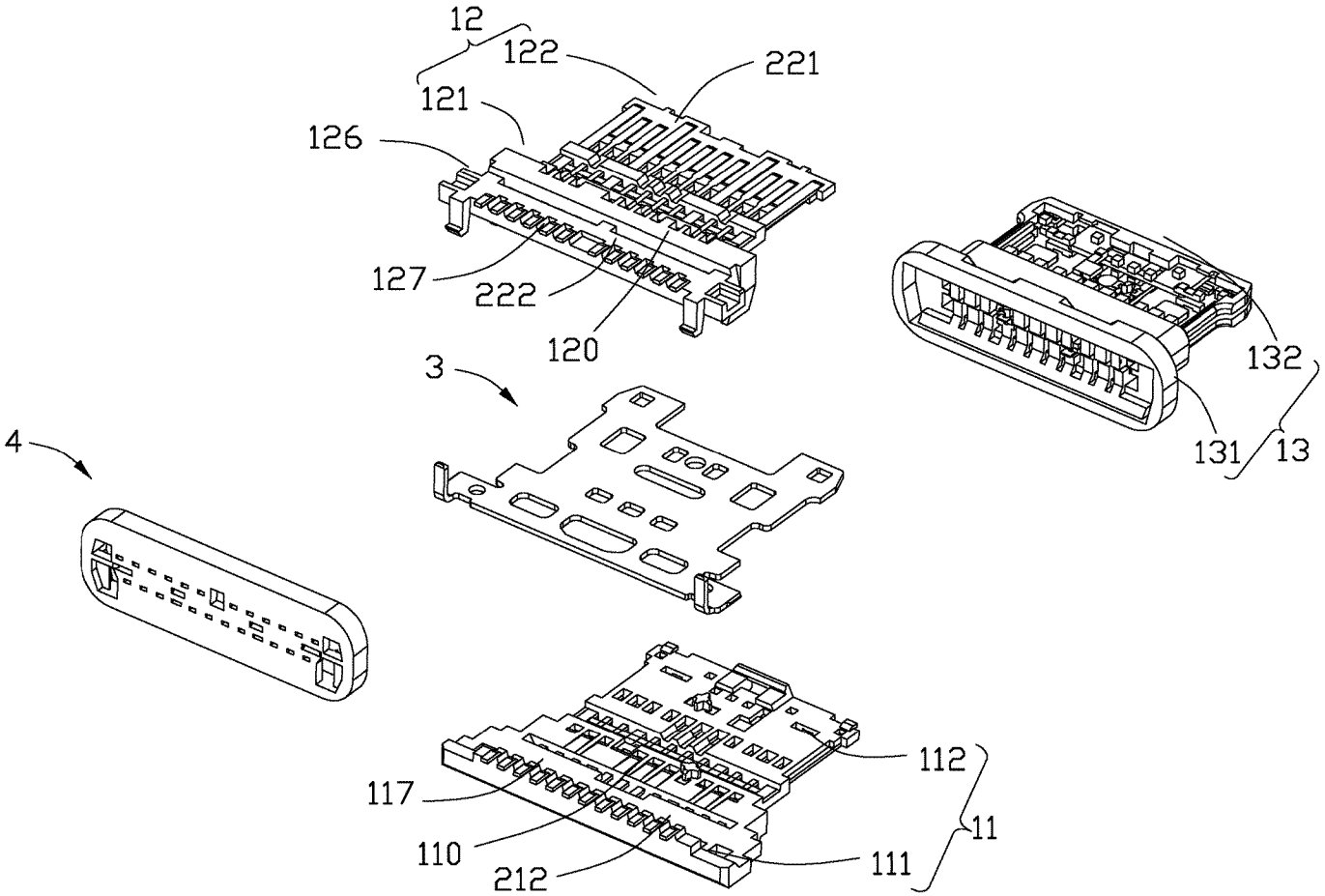
FIG. 7 is another perspective view of FIG. 6.

The first contacts 21 and the second contacts 22 are positioned to have 180 degree symmetry such that the corresponding plug connector can be inserted and operatively coupled to the electrical connector 100 in either of two orientations. The first contacts 21 and the second contacts 22 extend in an insertion direction and respectively include four power contacts located forwardly and eight signal contacts located backwardly. The two power contacts in the middle are used to provide electric source and the other two are used for electrical grounding. The eight signal contacts include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22. Referring to FIGS. 6 and 7, each grounding contact of the first contacts 21 has an end portion 210 bent downwardly and then extending forwardly. Each end portion 210 is located at a front end of each grounding contact of the first contacts 21 and exposed from a lower surface of the first tongue portion 112. Each grounding contact of the second contacts 22 has an edge portion 220 bent downwardly and then extending forwardly. Each edge portion 220 is located at a front end of each grounding contact of the second contacts 22 and exposed from an upper surface of the second tongue portion 122. In manufacture process, each of the end portions 210 and the edge portions 220 is reserved for a extending part exposed from a front end of the insulative housing 1 and then the extending part of each of the end portions 210 and the edge portions 220 is cut after insert-molding process. The end portions 210 and the edge portions 220 are communicated with each other via contacting with the metallic shielding plate 3 to decrease high frequency crosstalk and resonance oscillation.

Referring to FIGS. 6-7, the metallic shielding plate 3, shaping like a panel, includes a supporting section 31 sandwiched between the first tongue portion 112 and the second tongue portion 122, and a first affixed legs 32 extending downwardly from the supporting section 31.

Referring to FIGS. 6-7, the shielding shell 5 includes a top wall 51 and a bottom wall 52 located oppositely, and a pair of side walls 53 connected with the top wall 51 and the bottom wall 52. The top wall 51 and the bottom wall 52 have a number of dimples 54 protruding to the mating cavity to resist a shell of the mating connector and decrease holes exposed from the shielding shell 5 to enhance waterproof function. The top wall 51 has a pair of first clasp sections 55 bent downwardly from a rear end thereof and resisting a back-end of the insulative housing 1.

The metal shell 6 includes a tubular main section 61, a pair of second affixed legs 62, a baffling section 63 extending backwardly, and a pair of connecting section 64 extending in the up-and-down direction and connected with the main section 61 and the baffling section 63. The baffling section 63 has a number of windows 630 communicated with an upper surface and a lower surface and exposing and corresponding to the through-hole 114 of the insulative housing 1. The main section 61 defines an upper wall 611 and a pair of lateral walls 67 extending downwardly from the upper wall 611. The lateral wall 67 has a second clasp section 65 bent inwardly and resisting the concaved portion 126. The baffling section 63 has a rear wall 66 bent downwardly. The rear wall 66 has a pair of first resisting arms 661 bent forwardly from two sides thereof and a pair of second resisting arms 662 bent forwardly from a front end thereof. The first resisting arms 661 and the second resisting arms 662 shield behind the insulative housing 1. The lateral wall 67 has a pair of third resisting arms 671 located behind the corresponding second clasp sections 65. The first resisting arms 661 are resisted against by the third resisting arms 671 to affix the baffling section 63 and the main section 61 to enhance the stability of the baffling section 63. The connecting section 64 is separated with two parts which define a plurality of holes or openings therebetween for passage of glues or other sealing materials to form the glue wall 4. The baffling section 63 is perpendicular to the connecting section 64 to form a receiving cavity.

Figure 8:
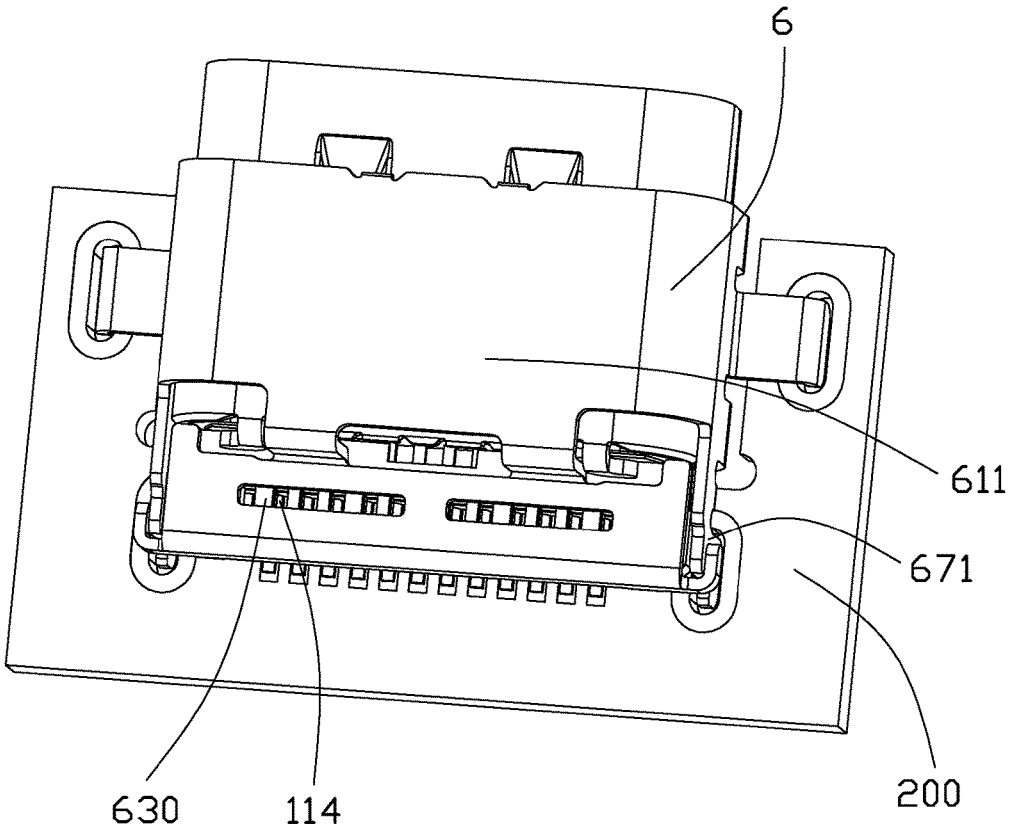
FIG. 8 is a cross-sectional view of the electrical connector along line 8-8 in FIG. 1.

Referring to FIG. 8, the electrical connector 100 is affixed to the printed circuit board 200. The first soldering portions 212 and the second soldering portions 222 are exposed from the through-hole 114 of the insulative housing 1 and the window 630 of the metal shell 6 to volatilize the soldering material.

Referring to FIG. 2, the electrical connector 100 defines a first sealing influx A, a second influx B, and a third influx C located at a back-end thereof. The sealing materials pour into the electrical connector 100 from the first sealing influx A, the second influx B, and the third influx C to seal up the terminals 2 exposed from the openings 110,120 and a part between the insulative housing 1 and the shielding shell 5.

However, the disclosure is illustrative only, changes may be made in detail, especially in matter of shape, size, and arrangement of sections within the principles of the invention.

What is claimed is:

1. An electrical connector comprising:

an insulative housing having a plurality of receiving slots located in an undersurface of a back-end thereof;

a plurality of terminals carried by the insulative housing, the terminals having a plurality of soldering portions located around the back-end of the insulative housing, each receiving slot being located between every two neighboring soldering portions to receive soldering material;

a metallic shielding plate retained in the insulative housing;

a shielding shell attached to the insulative housing; and a metal shell attached upon the shielding shell, wherein said insulative housing has a plurality of through-holes communicated with an upper surface and a lower surface of a rear portion thereof, and the soldering portions are exposed via the through-holes for observation, and said metal shell has a plurality of windows corresponding to the through-holes, and the soldering portions are observable from the windows.

2. The electrical connector as claimed in claim 1, wherein said shielding shell has a top wall and a bottom wall located oppositely, and the top wall and the bottom wall have a plurality of dimples protruding inwardly for resisting a mating connector.

3. The electrical connector as claimed in claim 1, wherein said insulative housing has a plurality of openings, and the openings are filled by sealing materials to seal up the terminals exposed therefrom.

4. The electrical connector as claimed in claim 1, wherein the soldering portions are arranged in inner and outer rows spaced from each other in a front-to-back direction while each of said inner row and said outer row extending along a transverse direction perpendicular to said front-to-back direction, the soldering portions in said inner row and the soldering portions in the outer row being alternately arranged with each other in the transverse direction, and the housing forming a row of through holes each extending therethrough in a vertical direction perpendicular to both said front-to-back direction and said transverse direction, said through holes being aligned with the corresponding soldering portions in said inner row in the vertical direction for inspecting soldering status of the corresponding soldering portions, while the corresponding soldering portions in said inner row are aligned, in the front-to-back direction, with the corresponding receiving slots located between the two neighboring soldering portions in the outer row.

5. An electrical connector comprising:

an insulative housing;

a plurality of terminals carried by the insulative housing, each of said terminals having a corresponding horizontal soldering portion; and a metal shell enclosing the insulative housing, the metal shell having an upper wall, a pair of lateral walls bent downwardly from the upper wall, a connecting section extending downwardly from a back-end of the upper wall, and a baffling section extending backwardly from a lower end of the connecting section to downwardly cover the housing, the baffling section extending along a transverse direction, two sides of the baffling section located close to corresponding lateral walls, wherein a glue wall seals a back surface of the housing and is located in front of the connecting section, and the terminals extend through the glue wall in a front-to-back direction, said connecting section forms openings in said front-to-back direction to allow sealing material to flow thereinto to form said glue wall, a plurality of receiving slots are formed in an undersurface of the housing, and each of said receiving slots is disposed between the every two horizontal soldering portions of the corresponding two adjacent terminals, and the soldering portions are arranged in inner and outer rows spaced from each other in said front-to-back direction perpendicular to the transverse direction while each of said inner row and said outer row extending along said transverse direction, the soldering portions in said inner row and the soldering portions in the outer row being alternately arranged with each other in the transverse direction, and the housing forming a row of through holes each extending therethrough in a vertical direction perpendicular to both said front-to-back direction and said transverse direction, said through holes being respectively aligned with the corresponding soldering portions in said inner row along the vertical direction for inspecting soldering status of the corresponding soldering portions, while the corresponding soldering portions in the inner row are respectively aligned, in the front-to-back direction, with the corresponding receiving slots located between the two neighboring soldering portions in the outer row.

6. The electrical connector as claimed in claim 5, wherein said connecting section is perpendicular to the upper wall and extends along an up-and-down direction to lower the baffling section below the upper wall, the baffling section is perpendicular to the connecting section to form a receiving cavity, and the connecting section has a hole beside for accommodating glues.

7. The electrical connector as claimed in claim 6, wherein said baffling section has a pair of first resisting arms extending forwardly from a back-end thereof, the lateral walls respectively have a third resisting arm bent downwardly and extending downwardly, and the first resisting arms are respectively resisted against by corresponding third resisting arms.

8. The electrical connector as claimed in claim 5, wherein the receiving slots each located between the corresponding soldering portions in the inner row, are respectively aligned, in the front-to-back direction, with the soldering portions in the outer row.

9. An electrical connector comprising:

an insulative housing having a base portion and a tongue portion extending from the base portion forwardly along a front-to-back direction, said tongue portion defining opposite upper and lower surfaces in a vertical direction perpendicular to said front-to-back direction;

a plurality of terminals retained in the insulative housing, the terminals having a plurality of horizontal contacting portions around the tongue portion, and horizontal soldering portions around an undersurface of the base portion of the insulative housing, the contacting portions being arranged, in the vertical direction, with opposite upper and lower rows respectively located upon the upper and lower surfaces of the tongue portion, the soldering portions being arranged, in the front-to-back direction, with opposite inner and outer rows, the soldering portions in the inner row and those in the outer row being alternately arranged with each other in a transverse direction perpendicular both said front-to-back direction and said vertical direction;

the housing forming a row of through holes each extending therethrough in said vertical direction, said through holes being respectively aligned with the corresponding soldering portions in said inner row along the vertical direction for inspecting soldering status of the corresponding soldering portions; and a shell subassembly enclosing the insulative housing to form a mating cavity in which the tongue portion extends, and including an upper wall located above the mating cavity, a connecting section extending downwardly from a back-end of the upper wall, and a baffling section extending backwardly from a lower end of the connecting section to downwardly cover the base portion of the housing, the baffling section extending along said transverse direction, said baffling section forming at least one window to upwardly expose the corresponding through holes in the vertical direction; wherein the connecting section forms at least one rearward opening beside to allow sealing material to be filled therein to form a glue wall in front of the connecting section and within the shell subassembly; wherein all the terminals extend through the glue wall in the front-to-back direction.

10. The electrical connector as claimed in claim 9, wherein said shell subassembly includes a shielding shell directly attached upon the housing to form said mating cavity, and a metal shell attached upon the shielding shell, and the upper wall, the connecting section and the baffling section all are formed on the metal shell.

11. The electrical connector as claimed in claim 9, wherein a metallic shielding plate is located between the terminal in the upper row and those in the lower row in the vertical direction.

12. The electrical connector as claimed in claim 9, wherein the tongue portion includes a first tongue portion and a second tongue portion with the shielding plate sandwiched between in the vertical direction, and the terminals in the upper row are integrally formed within a first tongue portion and the terminals in the lower row are integrally formed within a second tongue portion.

13. The electrical connector as claimed in claim 9, wherein an undersurface of said housing forms a plurality of receiving slots respectively located between every adjacent two soldering portions for receiving redundant soldering material, and the soldering portions in the inner row are respectively aligned, in the front-to-back direction, with the corresponding receiving slots in the outer row, and the soldering portions in the outer row are respectively aligned, in the front-to-back direction, with the corresponding receiving slots in the inner row.

* * * * *